US007810171B2

(12) United States Patent
Moore

(10) Patent No.: US 7,810,171 B2
(45) Date of Patent: Oct. 12, 2010

(54) NURSING GARMENT

(76) Inventor: Julia P. Moore, 1875 D'Arques Ct., Reno, NV (US) 89521

( * ) Notice: Subject to any disclaimer, the term of this patent is extended or adjusted under 35 U.S.C. 154(b) by 0 days.

(21) Appl. No.: 11/769,116

(22) Filed: Jun. 27, 2007

(65) Prior Publication Data

US 2009/0000008 A1 Jan. 1, 2009

(51) Int. Cl.
*A41D 1/20* (2006.01)

(52) U.S. Cl. ..... 2/104; 2/105; 2/106

(58) Field of Classification Search ..... 2/101, 2/104, 106, 69, 73, 78.1, 78.4, 113, 114, 2/109; 450/31, 36, 92
See application file for complete search history.

(56) References Cited

U.S. PATENT DOCUMENTS 907,290 A * 12/1908 Rouff ..... 2/104
1,098,155 A * 5/1914 Knapp ..... 2/104
1,489,046 A * 4/1924 Thompson ..... 2/114
D168,259 S * 11/1952 Giangrosso ..... D2/847
2,700,769 A * 2/1955 Polchinski ..... 2/93
2,736,031 A * 2/1956 Wyner ..... 2/111
2,911,650 A * 11/1959 Gerich ..... 2/74
3,276,036 A * 10/1966 Cater et al. ..... 2/114
4,208,743 A * 6/1980 Whitcraft ..... 2/104
4,566,136 A * 1/1986 Echols ..... 2/104
4,601,068 A * 7/1986 Frechette ..... 2/104
5,564,126 A * 10/1996 Chou ..... 2/114
5,727,256 A * 3/1998 Rudman ..... 2/115
D395,539 S * 6/1998 DiPietro ..... D2/849
D414,015 S * 9/1999 Small ..... D2/844
6,014,772 A * 1/2000 Connelly ..... 2/69
6,282,717 B1 * 9/2001 Ng ..... 2/70

* cited by examiner

*Primary Examiner*—Gary L Welch
*Assistant Examiner*—Richale L Quinn
(74) *Attorney, Agent, or Firm*—Armstrong Teasdale LLP

(57) ABSTRACT

A T-shirt style nursing garment is described. A T-shirt or other type of torso garment has an opening along the sides of the garment starting from under the arm to approximately half-way down the length of the garment. The opening is not apparent or obvious to someone looking at the garment. The nursing garment allows a woman to breastfeed without exposing any portion of the breast or shoulder. In order to provide access to the breast by a nursing infant, the woman does not have to unhook or unzip the garment or remove any other portions of clothing, such as panels or flaps. Upon separating the back and front panels of the nursing garment to create the opening, the woman pulls the front panel of the garment toward the middle of her chest thereby creating the opening and exposing the breast for the nursing infant.

9 Claims, 4 Drawing Sheets

NURSING GARMENT

BACKGROUND OF THE INVENTION

1. Field of the Invention

The present invention relates to garments for nursing women to facilitate breastfeeding of their babies. More specifically, it relates to a garment covering a woman's torso, such as a T-shirt, that enables nursing an infant while minimizing adjustment of the woman's clothing and has the appearance of a regular, non-nursing garment.

2. Description of the Related Art

Mothers of newborn babies and infants have long been advised to breastfeed their children. However, because of women's typically active work schedules and lifestyles, they must often wear clothing that allows them to breastfeed in many locations other than in the home. Nursing women may also prefer wearing a garment that does not have the appearance of being a nursing garment for aesthetic reasons. Consequently, a need has existed for a garment, such as a long or short sleeve T-shirt style garment, that allows for breastfeeding with minimal exposure of the mother's torso and that appears to be a regular, non-nursing T-shirt.

Presently, T-shirts and similar garments that facilitate breastfeeding have visible features that make it apparent that the T-shirt is a nursing garment. Many women feel that these features detract from the garment's appeal, style, and aesthetic. Some nursing women would prefer to wear a regular or conventional looking T-shirt or other more fashionable garment but still be able to breastfeed comfortably while wearing the garment. For example, many women would like to wear a contemporary, form-fitting T-shirt or top that contains no obvious indicia of being a nursing garment. Some women would also prefer to avoid having to unhook, untie, or unzip any part of the garment or T-shirt or have to adjust or move layers of clothing or material attached in some manner to the garment or that work in conjunction with the garment. These obvious functional features of present nursing garments detract from their appearance to some mothers and make it obvious that the woman is wearing a nursing garment. Thus, there is a need for a T-shirt style nursing garment that has the appearance of a regular T-shirt, does not require significant adjustment, and minimizes exposure of the mother while breastfeeding.

SUMMARY OF THE INVENTION

A novel nursing garment that allows for breastfeeding with minimal exposure of the breast and having the appearance of a regular, non-nursing garment is described. In one aspect of the invention, the nursing garment is styled as a long or short sleeve T-shirt which may optionally have a design on the front, back or along the sleeves giving the T-shirt a non-typical nursing garment appearance. The garment has a front panel having at least one upper side section located near a breast and the side of the garment. A side seam connects the front panel of the garment to a back panel. The side seam has an upper segment and a lower segment, where the upper segment extends from near or immediately below the armpit area of the garment to approximately mid-way down the side of the garment ending at or near the middle of the woman's torso. The lower segment begins at the lower ending point of the upper segment and extends to the bottom of the garment. The upper segment has a seal and can be opened and closed as desired by a nursing woman. When the seal is closed, the upper segment of the seam has the general appearance of a normal seam and to others seeing the garment being worn, is generally indistinguishable from the lower segment of the seam.

When the seal of the upper segment is opened, the woman wearing the garment can control exposure of a breast for breastfeeding. The upper side segment can be opened by detaching the means being used to seal the front panel and the back panel. Once detached or unsealed, a breast can be exposed by pulling or moving the upper side section of the front panel towards the middle of the woman's chest as far as necessary to sufficiently enable breastfeeding. There are no flaps, layers, or other components of the garment that need to be moved or adjusted in order to open the seal and facilitate nursing. The seal may utilize one of several means including multiple hook and loop materials, such as Velcro, laces, buttons, snaps, and the like. The sealed upper segment portion may extend from the armpit area of the garment to any point below the mid-torso area, for example, to the nearly the bottom of the garment, thereby allowing the creation of a larger opening if desired.

BRIEF DESCRIPTION OF THE DRAWINGS

References are made to the accompanying drawings, which form a part of the description and in which are shown, by way of illustration, specific embodiments of the present invention.

DETAILED DESCRIPTION OF THE INVENTION

Exemplary embodiments of a nursing garment according to the present invention are described. These examples and embodiments are provided solely to add context and aid in the understanding of the invention. Thus, it will be apparent to one skilled in the art that the present invention may be practiced without some or all of the specific details described herein. In other instances, well-known concepts and garment components have not been described in detail in order to avoid unnecessarily obscuring the present invention. Other applications and examples are possible, such that the following examples, illustrations, and contexts should not be taken as definitive or limiting either in scope or setting. Although these embodiments are described in sufficient detail to enable one skilled in the art to practice the invention, these examples, illustrations, and contexts are not limiting, and other embodiments may be used and changes may be made without departing from the spirit and scope of the invention.

A garment that facilitates breastfeeding by a woman styled as a T-shirt that does not have the appearance of a nursing garment and minimizes exposure of a woman's breast while breastfeeding is described in the various figures. Presently, many nursing garments have obvious or at least some apparent features indicating that the garment is not a regular garment but is specially tailored or styled as a garment that enables a woman to breastfeed an infant. In the described embodiment, a T-shirt styled garment has the appearance of a regular, non-nursing garment yet allows a woman to nurse with minimal exposure. In addition, the garment does not require partial disrobing by the woman or removal of any undergarments. Various alternative embodiments of the present invention are described further below.

Figure 1:
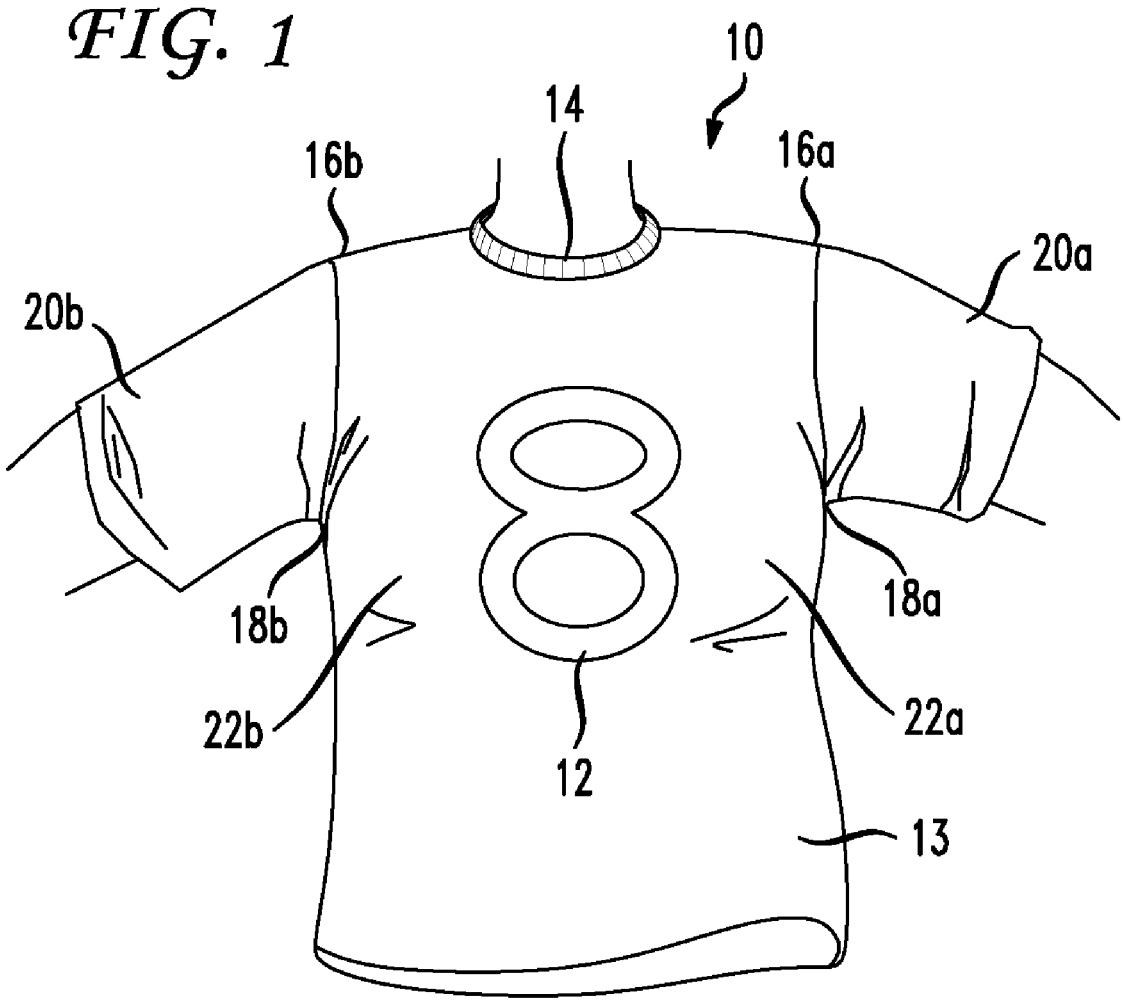
FIG. 1 is a frontal view of a nursing garment in accordance with one embodiment of the present invention.

As shown in FIG. 1, a T-shirt 10 has a collar component 14 and a design 12 on a front panel 13 in accordance with the described embodiment of the present invention. Embellishment 12 may be a screen print, embroidery work, beading, and the like that may appear on any other non-nursing male or female T-shirt. Garment 10 has sleeves 20*b* and 20*a*, which can be long sleeve or short sleeve. Sleeves 20*a* and 20*b* begin on the top shoulder portion at points 16*a* and 16*b*, respectively, and begin at the bottom underarm portion at points 18*a* and 18*b*, respectively. Two areas 22*a* and 22*b* of front panel 13 are also shown. The relevance of these areas is described below. Garment 10 has no internal or underlying components and the appearance of garment 10 as shown in FIG. 1 (and in FIG. 5 below) is what an observer may see while the garment is being worn. As is apparent from FIG. 1, garment 10 looks like a regular, non-nursing item of clothing.

Figure 2:
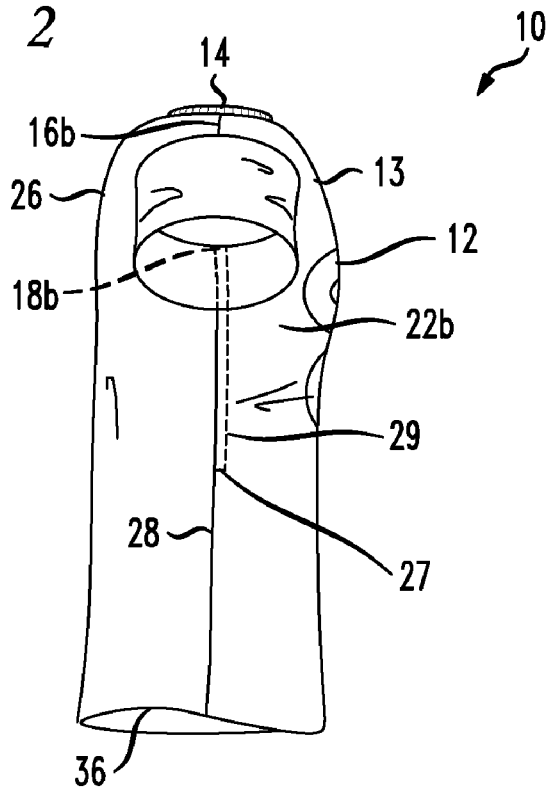
FIG. 2 is a side view of a nursing garment with the side opening sealed.
Figure 6:
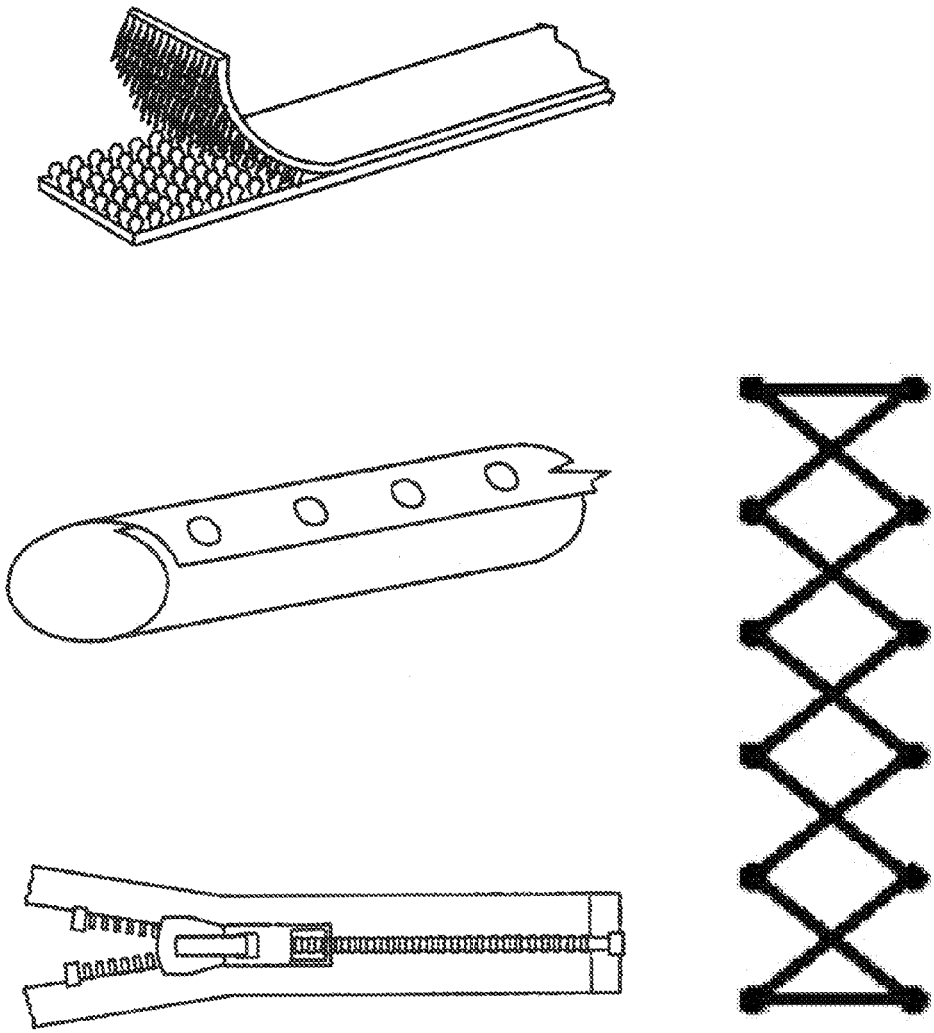
FIG. 6 illustrates examples of sealing means in accordance with one embodiment of the present invention.

FIG. 2 is a side view of a nursing garment with a side aperture sealed in accordance with one embodiment of the present invention. Collar 14 is shown on top of garment 10 and portions of embellishment 12 can be seen. As described in FIG. 1, there is front panel 13 and side portion 22*b* near the under arm area shown in FIG. 2. Also shown in FIG. 2 is a rear or back panel 26 which extends to a bottom 36 of garment 10, as does front panel 13. Garment 10 has a side seam 28 that extends from bottom point 18b of the sleeve, as described in FIG. 1, to garment bottom 36, and that connects front panel 13 with back panel 26. The seal may utilize one of several means including multiple hook and loop materials, such as Velcro, laces, buttons, snaps, and the like. FIG. 6 illustrates examples of sealing means in accordance with one embodiment of the present invention.

In the described embodiment of the present invention, side seam 28 has two segments. A bottom side segment extends from a point 27 to garment bottom point 36 and is normally stitched or sewn in a permanent manner. In other embodiments, point 27 can be higher or lower than that shown in FIG. 2. Point 27 is preferably at a point below the woman's breast and, as such, its position along side seam 28 may vary. In the described embodiment, a top side segment extends from point 27 to point 18*b*. This top side segment is not permanently sewn or stitched, as indicated by the dashed line 29. In the described embodiment, point 27 is vertically positioned along side seam 28 to allow a woman to pull front panel side portion 22*b* towards the middle of the woman's chest in a manner that provides access to the woman's breast and will not pull rear panel 26, as described and shown in FIGS. 3 and 4.

Figure 3:
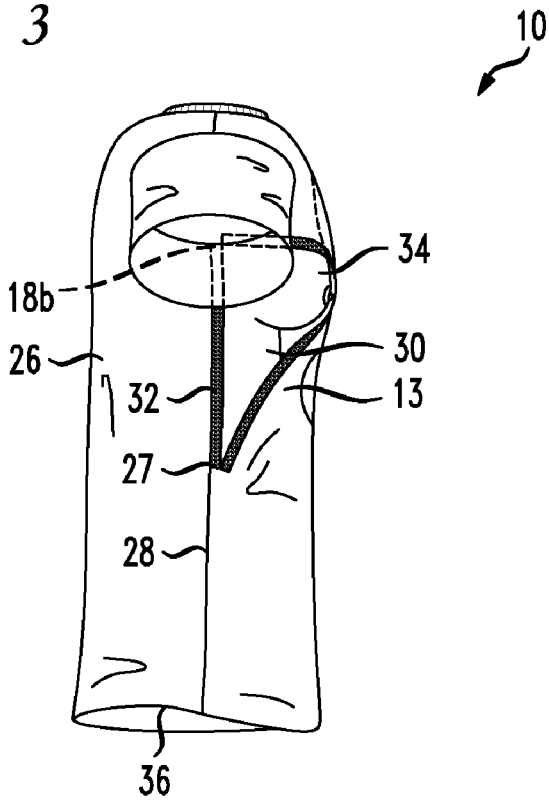
FIG. 3 is a side view of a nursing garment showing an open seal thereby exposing a breast for breastfeeding in accordance with one embodiment of the present invention.

FIG. 3 is a side view of a nursing garment showing an unsealed or open top side segment creating an aperture for exposing a breast for breastfeeding in accordance with one embodiment of the present invention. A top side segment 32 shows the segment shown in FIG. 2 by dashed line 29 in an unsealed or open position. An aperture 30 provides access to breast 34. This is done by the woman pulling on front panel side portion 22*b*, thereby opening the seal and creating aperture 30. Aperture 30 may extend from point 27 to point 18*b*. The woman wearing garment 10 and wanting to breastfeed can pull portion 22*b* as far towards the center of the woman's chest as desired. In the described embodiment, the lower point 27 is along side seam 28, the larger the aperture may be when pulled toward the center of the woman's chest. If point 27 is positioned higher along seam 28, the more difficult it may be to create a sufficiently sized aperture for breastfeeding. This may also cause rear panel 26 to be pulled toward the front of the woman's torso in an uncomfortable manner.

Figure 4:
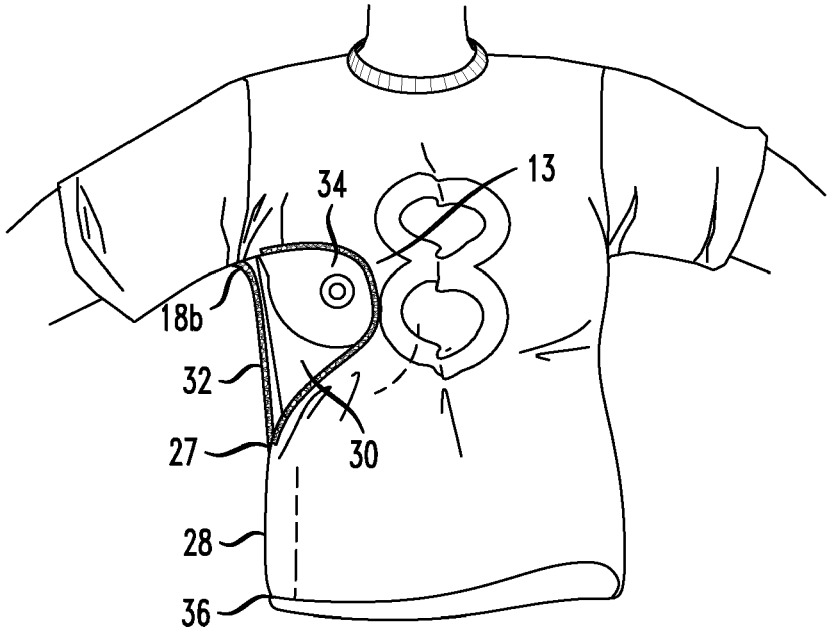
FIG. 4 is a frontal view of a nursing garment showing a seal in the open position thereby exposing a breast for breastfeeding.

FIG. 4 is a frontal view of nursing garment 10 shown worn on a woman's torso with aperture 30 providing access to breast 34. As shown in FIGS. 3 and 4, top side segment 32 is open to maximize access to breast 34. Top side segment 32 need not be opened completely to enable nursing. A woman may partially open seal 29 starting from either bottom point 27 or from top point 18*b*. In the described embodiment of the present invention, there are no other clothing components, such as internal or external flaps, that are part of garment 10 to facilitate breastfeeding. For simplicity, garment 10 is shown in the figures without any undergarments, such as a bra, camisole, etc. However, garment 10 may facilitate breastfeeding if a woman is wearing such undergarments. Upon unsealing the top side segment of the garment and creating an aperture, a woman can unhook, move aside, or otherwise remove any underlying garment.

Figure 5:
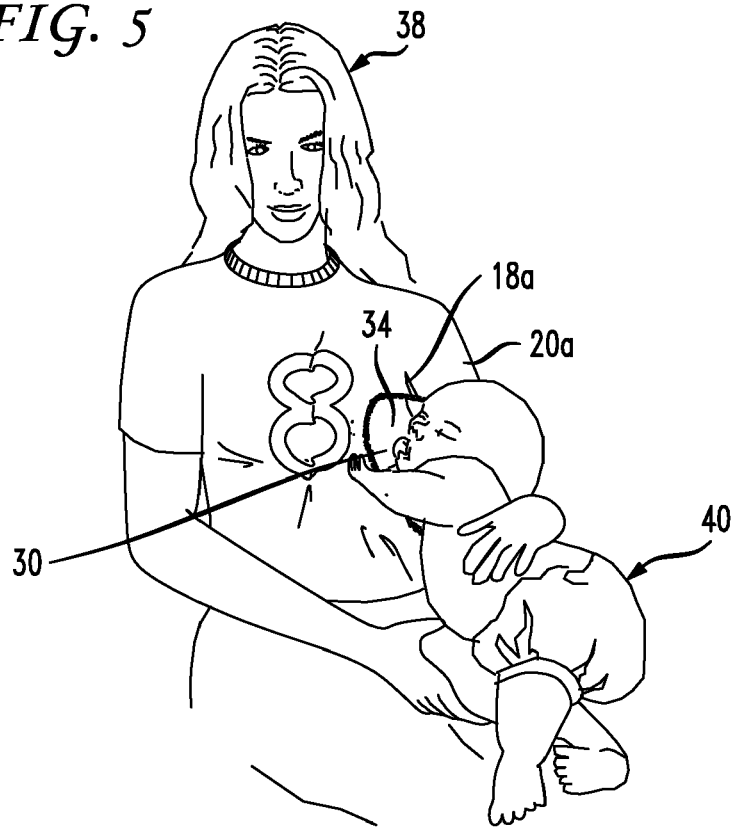
FIG. 5 is a frontal view of a woman breastfeeding a baby wearing a nursing garment in accordance with one embodiment of the present invention.

FIG. 5 is a frontal view of a woman breastfeeding a baby wearing nursing garment 10 in accordance with one embodiment of the present invention. A woman 38 wearing garment 10 is nursing an infant 40. Aperture 30 is created by pulling front side portion 22*a* as shown in FIG. 1 toward the center of the chest. Once pulled, side portion 22*a* (not shown in FIG. 5) may assume an unsealed position thereby comfortably forming and maintaining aperture 30, which in the described embodiment begins at about top point 18*a*. The size of aperture 30 can be adjusted by woman 38 wearing garment 10 thereby controlling exposure of breast 34. Given that in the described embodiment, there is no extra material or clothing that is needed to cover the breast while nursing, it allows the nursing mother to maintain eye contact between mother and nursing child, thereby promoting calm, steady nursing as recognized by mothers and nursing specialists.

As described, seal 29 can be opened to create aperture 30. Various mechanisms can be used to create seal 29. Preferably ones that allow a woman to open and close the seal with one hand and do not involve extraneous or additional material should be used. For example, a Velcro® attachment or any other type of multiple hook-and-loop material can be used. In this embodiment, the "hook" side of the material may be attached to a tab running vertically along the side of seal 29. The "loop" side of the material may run vertically on a tab on the inside of seal 29. In another example, tabs and character strips used as a fastener in diapers may also be used to create seal 29. Other common garment seals such as zippers, laces, snap, and buttons may be used, although, as noted, it is preferable that the seal be easily opened by the woman wearing the garment and remain closed when sealed. Further, the effectiveness of sealing and re-sealing the opening should be generally maintained upon long-term use, which may limit the utility of, for example, the tab and character strip fastener. In the described embodiment, it is preferable that garment 10 not require any releasing or adjusting of any fastening devices for opening and sealing seal 29. As is evident to one of ordinary skill in the art, there are many variations and possible implementations of the mechanism or material used to create seal 29.

In other embodiments of the present invention, garment 10 may be a bodice portion of a dress or other type of torso component of a full-length woman's garment. Garment 10 may also be a sports or active wear style T-shirt having a form-fitting design or a more formal top, such as a blouse.

Garment 10 may also be sleepwear or an undergarment. Generally, garment 10 may have various styles, patterns, shapes and can be made of different types of fabric, such as a flexible fabric that stretches easily (e.g., a Jersey knit fabric).

In the described embodiment, aperture 30, seal 29, and other components and features described above are on both sides of garment 10. In another embodiment, aperture 30 may only be formed on one side of garment 10. The other side may have a permanent side seal that extends from bottom point 36 to point 18*a* or 18*b*, as in a regular, non-nursing garment on the other side.

Although illustrative embodiments and applications of this invention are shown and described herein, many variations and modifications are possible which remain within the concept, scope, and spirit of the invention, and these variations would become clear to those of ordinary skill in the art after perusal of this application. Numerous stylistic modifications can be made to garment 10 without exceeding the scope of the present invention. Accordingly, the embodiments described are to be considered as illustrative and not restrictive, and the invention is not to be limited to the details given herein, but may be modified within the scope and equivalents of the appended claims.

I claim:

1. A nursing garment comprising:

a front panel having an upper side section;

a back panel;

a sleeve coupled to the front panel and the back panel, said sleeve having a bottom point; and a side seam having an upper segment and a lower segment that is different from the upper segment, the side seam connecting the front panel and the back panel, wherein the upper segment includes a seal that is able to be opened and closed such that when the seal is open, the front panel and the back panel are not connected so that a breast can be exposed for breastfeeding and when the seal is closed, the front panel and the back panel are connected so that the garment has the appearance of a non-nursing garment, wherein the lower segment permanently connects the front panel and the back panel, and wherein the upper segment extends from the sleeve towards the lower segment along the side seam at approximately a mid-torso area of a woman wearing the nursing garment, and such that when the seal is open and the upper side section of the front panel is pulled toward a center of a woman's chest, an aperture is created in the upper segment of the side seam exposing the breast for nursing.

2. A nursing garment as recited in claim 1 wherein the upper segment begins at the bottom point of the sleeve and wherein the bottom location of the upper segment is approximately three-quarters of the way down the torso of the woman.

3. A nursing garment as recited in claim 1 wherein the bottom location of the upper segment is at or near the bottom of the nursing garment.

4. A nursing garment as recited in claim 1 wherein the seal is a multiple hook and loop type material.

5. A nursing garment as recited in claim 1 wherein the seal is one of a zipper, lace, a plurality of snaps, and a plurality of buttons.

6. A nursing garment as recited in claim 1 wherein the seal is only on one side of the nursing garment.

7. A nursing garment as recited in claim 1 wherein no underlying or external components of the garment need to be adjusted to enable creating an opening and facilitating breastfeeding.

8. A nursing garment comprising:

a sleeve;

a front panel; and a back panel coupled to said front panel along an upper side seam and a lower side seam that is distinct from said upper side seam, said upper side seam extending from the sleeve, said upper side seam selectively configurable between an open configuration, wherein said front panel is decoupled from said back panel and a wearer's breast is exposed, and a closed configuration, wherein said front panel is coupled to said back panel.

9. A nursing garment comprising:

a sleeve;

a front panel; and a back panel coupled to said front panel along a side seam including an upper portion and a lower portion, said side seam extending from the sleeve, said upper portion comprising at least one of a multiple hook and loop type material, a zipper, lace, a plurality of snaps, and a plurality of buttons, wherein said upper portion is selectively coupled and decoupled, said lower portion coupling the front panel and the back panel in a permanent manner.

* * * * *

UNITED STATES PATENT AND TRADEMARK OFFICE

CERTIFICATE OF CORRECTION

PATENT NO. : 7,810,171 B2
APPLICATION NO. : 11/769116
DATED : October 12, 2010
INVENTOR(S) : Moore It is certified that error appears in the above-identified patent and that said Letters Patent is hereby corrected as shown below:

On the Front Page, at (76) Inventor, delete "Julia P. Moore" and insert therefor --Julia J. Moore--.

Signed and Sealed this

Seventh Day of December, 2010

David J. Kappos

David J. Kappos
*Director of the United States Patent and Trademark Office*